United States Patent [19]

Messerschmidt

[11] 3,972,216

[45] Aug. 3, 1976

[54] RECIPROCATING PRESS

[75] Inventor: Klaus Messerschmidt, Schonungen, Germany

[73] Assignee: Firma Sebastian Messerschmidt, Spezialmaschinenfabrik, Schonungen, Germany

[22] Filed: Jan. 29, 1975

[21] Appl. No.: 545,062

[30] Foreign Application Priority Data

Feb. 6, 1974 Germany ..... 2405530

[52] U.S. Cl. ..... 72/337; 10/12 R; 10/25; 72/361

[51] Int. Cl.[2] ..... B21D 28/00

[58] Field of Search ..... 72/337, 361, 360, 404, 72/416; 29/148.4 B, 148.4 R; 10/12 R, 25

[56] References Cited

UNITED STATES PATENTS

| | | | |
|---|---|---|---|
| 2,936 | 11/1863 | Watkins | 10/12 R |
| 46,434 | 2/1865 | Watkins | 10/12 R |
| 756,212 | 4/1904 | Campbell | 72/337 |
| 1,857,997 | 5/1932 | Brennan | 72/416 X |
| 1,897,359 | 2/1933 | Brennan | 72/337 |
| 2,315,769 | 4/1943 | Carney | 10/12 R |
| 2,800,814 | 7/1957 | Lewis | 72/361 X |
| 2,966,087 | 12/1960 | Gray | 29/148.4 B X |

*Primary Examiner*—C.W. Lanham
*Assistant Examiner*—James R. Duzan
*Attorney, Agent, or Firm*—Frank J. Jordan

[57] ABSTRACT

A reciprocating press for shaping or forming a workpiece such as a sphere or the like includes two oppositely reciprocally movable dies mating with two fixed dies. A feed mechanism reciprocal in a lateral direction is operable to shear off workpieces from an elongated rod and to feed the sheared off workpieces to the fixed dies as the movable dies move in opposite directions.

5 Claims, 4 Drawing Figures

FIG. 2
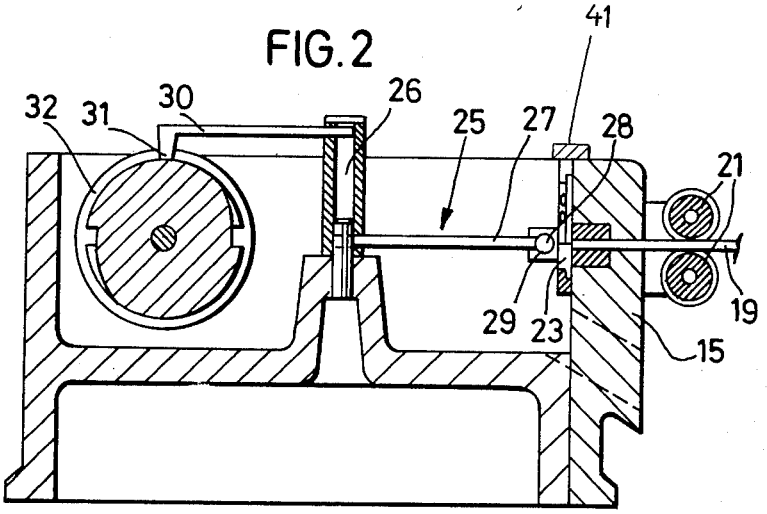
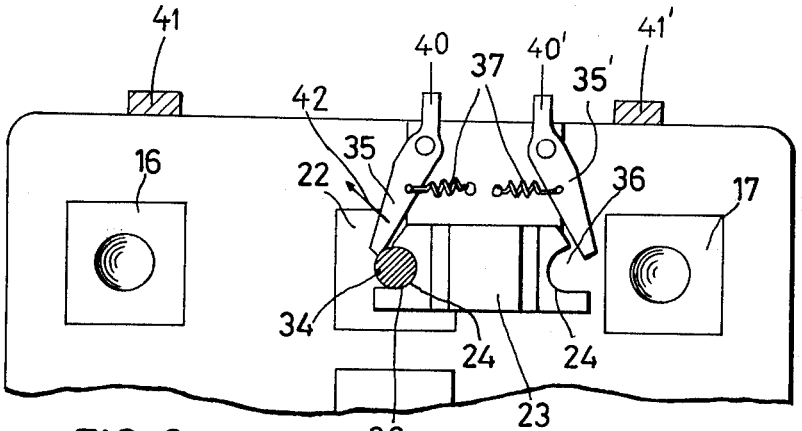
FIG. 3

RECIPROCATING PRESS

BACKGROUND OF THE INVENTION

This invention relates to a reciprocating press for shaping or forming simple workpieces such as spheres and the like out of rod parts within a die or mold cooperable with a mating die or mold wherein one of a pair of dies is reciprocated by a crankshaft and the other die of the pair is secured to a frame. The workpiece which is to be shaped or formed is cut off by a shear-off cutter of a feed mechanism which feeds the workpiece to the dies.

Each full turn of a crankshaft causes in a center press of the type known in the art, a molding action, usually when the forward stroke of the sliding carriage carrying the movable die occurs. The extremely large forces occurring at that moment demand a correspondingly large stability of the frame of the press which carries the fixed die. The output of such a press depends only on the speed which governs a cycle of operations, that is the cycle involving the opening and closing of the two dies which form the mold. The operating speed can be practically increased only at the expense of the weight or mass being moved, but there are very narrow limits to a diminution of these weights or masses.

Doubly acting reciprocating presses are known where one mold each is arranged oppositely upon both sides of a crankshaft. For that purpose the already very heavy mounting must be built doubly heavy which leads to an undesired heavy construction.

Accordingly, there exists a need to increase the output of such reciprocating presses, and this is achieved, according to one embodiment of the present invention, by providing two molds with one mold each being arranged side-by-side on both sides of a feed mechanism. The movable dies of the molds are driven by a crankshaft which has crank arms staggered or offset 180° relative to one another and a shear-off knife disposed reciprocatingly between the fixed dies, the shear-off knife providing on both frontal ends a cutting edge and a holding fixture for the reciprocal feeding of workpieces to each of the fixed dies.

The parallel arrangement of two molds side-by-side according to the present invention allows a particularly economical use of the press frame which is exposed to the mold pressure because each full turn of the crankshaft causes two molding cycles. Accordingly, each time only a single molding pressure acts upon the press frame. Therefore, output of a reciprocating press can be doubled while it runs at the same speed, and this can be accomplished practically without enlarging the frame. Thus the frame is better utilized.

According to one embodiment of the present invention, there is provided a feed mechanism common to both molds, such feed mechanism being doubly acting. Thus at the forward stroke, there is effected a cutting off of a workpiece and a feeding of the cut-off workpiece to the fixed die, and at the return stroke, there is effected a cutting-off again of another workpiece, and a feeding of the latter workpiece to the other fixed die.

The side-by-side arrangement of two carriages together with the movable dies causes an excellent equilibration while the identical weights or masses are movable. It is, of course, possible and known in the art to furnish each mold with two or more dies.

According to another embodiment of the present invention, there is provided near each fixed die a separate feeding mechanism with a shear-off knife and a workpiece holding fixture in order to feed the particular die. This latter embodiment has the advantage that both molds may be arranged extremely close to each other, an arrangement which results in a still more economical construction and an improved control of arising forces. It is possible to determine from case to case which one of these independent embodiments is more advantageous in each particular situation.

The movement of one or both feeding mechanisms depends advantageously on the movement of the crankshaft. This dependence may be realized by a cam carried on the crankshaft, such cam mating with one lever arm of a double arm rocking lever, the other lever arm of the double arm rocking lever mating with the carriage in the direction of the feed of the workpiece. It is also possible, for example, to arrange a cone pulley drive upon the main shaft and to regulate the rocker arms by the cam shaft so that the rocker arms move the carriage of the shear-off knives and the support for the separated workpiece each time from one final position into the other final position.

Other features which are considered characteristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and operation of the invention, however, together with additional objects and advantages thereof will be best understood from the following description of specific embodiments when read in connection with the accompanying drawings.

SUMMARY OF THE INVENTION

A reciprocating press for forming articles such as sphere-like objects and the like from workpieces includes a crankshaft rotatably mounted on a frame. The crankshaft has crank arms off-set 180° relative to one another and connecting means disposed side-by-side are operatively connected to the crank arms. Movable dies are carried by the connecting means and fixed mating dies are mounted on the frame. A feeding mechanism provided for feeding workpieces to the fixed dies includes cutting edge means for shearing the workpieces from an elongated rod or the like. The feed mechanism is reciprocal in a direction transverse to the reciprocal direction of the connecting means which carry the movable dies, whereby the feed mechanism is operable to cut off the workpiece and feed the cut-off workpieces to the fixed dies as the movable dies move in opposite directions.

BRIEF DESCRIPTION OF THE DRAWINGS

FIG. 2 is a sectional view taken along the line II—II in FIG. 1.

FIG. 3 is a sectional view taken along the line III—III in FIG. 1.

DESCRIPTION OF THE PREFERRED EMBODIMENTS

Figure 1:
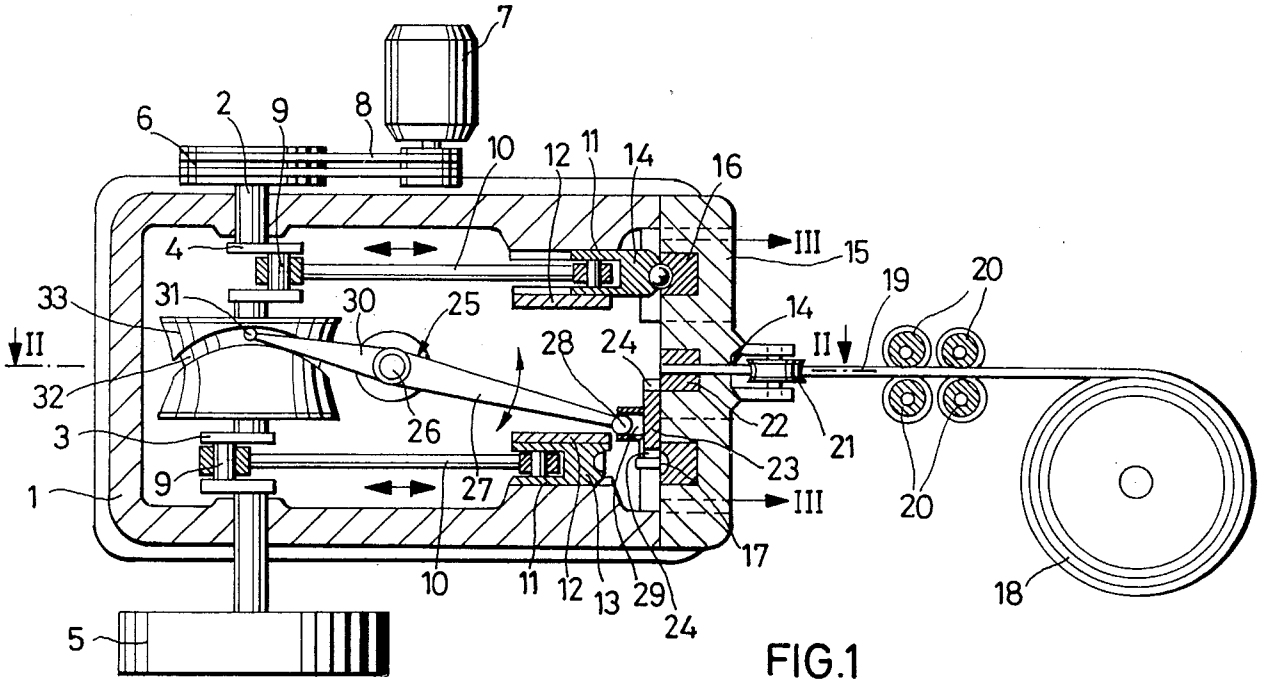
FIG. 1 is a horizontal sectional view of a reciprocating press according to a first embodiment of the present invention.

Referring to the drawings, there is shown a crankshaft 2 rotatably supported on a frame 1 which, by way of example, may be rectangularly shaped. The crankshaft 2 has two crank arms 3 and 4, both of the crank arms 3 and 4 being offset by 180°. A disengageable flywheel 5 is mounted at one end of the crankshaft 2. The other end of the crankshaft 2 is provided with a V-belt pulley 6 in order to drive the crankshaft 2 by means of a motor 7 through a V-belt 8 or similar means. The crankshaft 2 is provided with two crankshaft pins 9 on which two connecting rods 10 are mounted. The other ends of the connecting rods 10 are connected respectively to two carriages 11 which are guided longitudinally within guides 12.

Dies 13 and 14 are arranged upon each carriage 11. Each die 13 and 14 forms a mold when mated with fixed dies 16 and 17 respectively, the fixed dies 16 and 17 being arranged in a crown 15 on the frame 1. The 180° staggering of the two crank arms 3 and 4 on the crankshaft 2 causes the two movable dies 13 and 14 to move in a reciprocating manner.

A common feed mechanism is provided for both molds in order to feed and introduce workpieces to the molds. This feed mechanism consists of a reel 18 from which a coiled feed rod or the like 19 is pulled off across rolls 20 and 21. The end of the feed rod 19 is led into a feed bushing 22. The feed mechanism also includes a carriage 23 disposed in front of the exit opening of the feed bushing 22 in such a manner that the carriage may be moved back and forth between the two fixed dies 16 and 17. The carriage 23 is furnished at both ends with a shear-off cutting edge means or knife 24 so that the carriage is capable of moving in both directions to shear off the end of the feed rod 19 which extends into the interior space of the frame 1. The carriage 23 also serves to guide the separated workpiece into the respective fixed die 16 or 17.

The carriage 23 is driven by a two-armed rocking lever 25 which is fastened to a pivotal pin 26. One lever arm 27 has a spherical head 28 which mates with a bushing 29 disposed on the carriage 23. The other lever arm 30, which becomes thinner toward its end, of the two-armed rocking lever 25 mates with a cam 33 by the aid of a guide pin or cam follower 31 running in a guide groove 32 in the cam 33. The cam 33 is fastened to the crankshaft 2. Accordingly, this construction synchronizes the motion of the carriage 23 of the feed mechanism with the pressure stroke.

The carriage 23 is provided with holder means 36 for the cut off workpiece 34 adjacent each shear-off knife 24. Thus the holder means 36 also includes, in the example shown, of swivel cams 35,35' which are moved into closed positions by the springs 37. The swivel cams 35,35' have extensions 40,40' which are adapted to engage fixed lugs 41,41' respectively. The swivel arms 35,35' hold the workpiece in place in the position on the carriage 23. Referring to FIG. 3, when the carriage 23 moves all the way to the left, the extension 40 engages the fixed lug 41 to pivot the swivel cam 35 in the direction of arrow 42 to thereby release the workpiece 34. The fixed lug 41' performs the same function when the carriage 23 moves to the right in FIG. 3. Alternatively, the extensions 40,40' and lugs 41,41' may be omitted. Thus the dies 13,17 and 14,16 will grip the workpiece 34 and the swivel cams 35,35' will open by themselves against the bias of springs 37 when the carriage 23 commences its return stroke.

Figure 4:
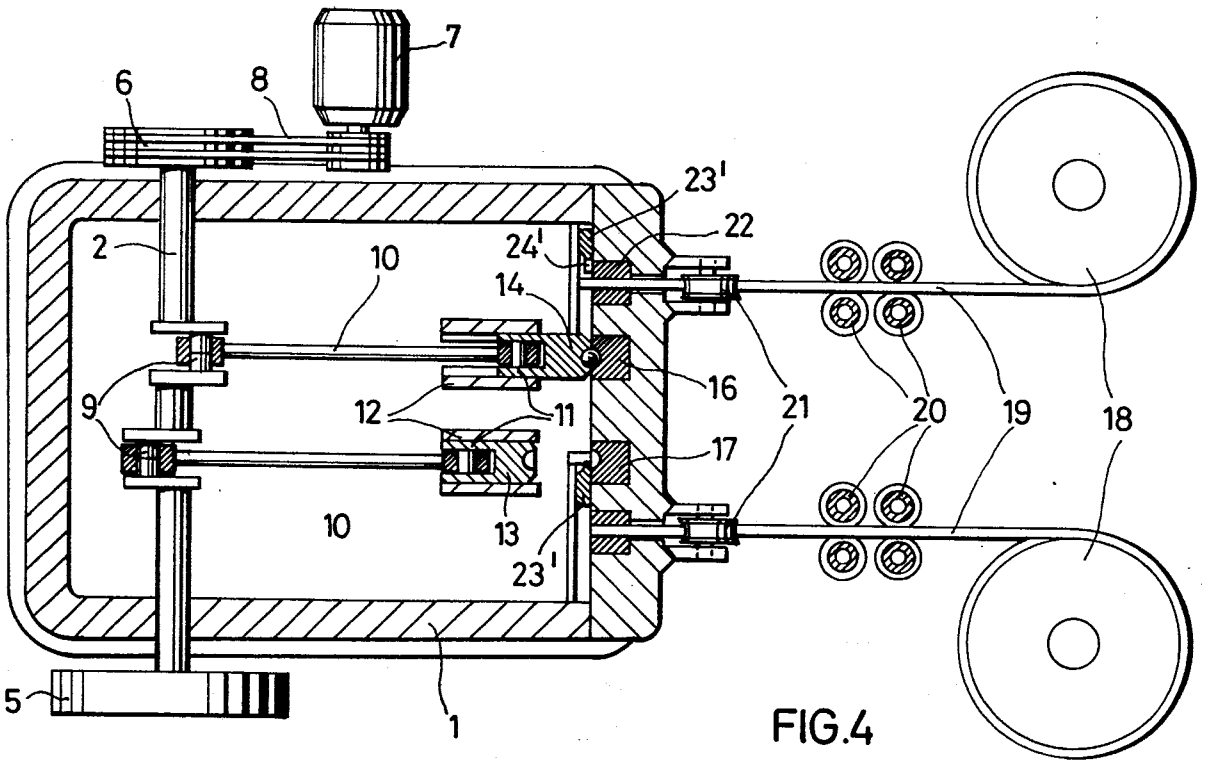
FIG. 4 is a horizontal sectional view of an alternate embodiment in a simplified representation.

An alternate embodiment according to FIG. 4 is shown greatly simplified.

The embodiment of FIG. 4 consists of dies 14,16 and 13,17 which are disposed side-by-side. A separate carriage 23' is arranged for each workpiece feed. Each carriage 23' is located upon the exterior side of each of the two molds. Accordingly, the embodiment of FIG. 4 also includes two reels 18 and also two sets of guide rollers 20,21, practically in a mirror-like arrangement.

In the embodiment of FIG. 4, each carriage 23' includes a shear-off knife 24' and each carriage 23' may be reciprocated laterally by a separate mechanism such as shown and described hereinbefore.

It is thought that the invention and many of its attendant advantages will be understood from the foregoing description and that it will be apparent that various changes may be made in the form, construction, and arrangements of the parts without departing from the spirit and scope of the invention or sacrificing all of its material advantages. The form heretofore described being merely a preferred embodiment thereof.

What is claimed is:

1. A reciprocating press for forming articles such as sphere-like objects and the like from workpieces comprising a frame, a crankshaft rotatably mounted on said frame, said crankshaft having crank arms offset 180° relative to one another, connecting means disposed side-by-side and operatively connected to said crank arms, movable dies carried by each of said connecting means, two fixed mating dies mounted on said frame, a feed mechanism reciprocable mounted between said two fixed dies, said feed mechanism being reciprocal in a direction transverse to the reciprocal direction of said connecting means which carry said movable dies, means for feeding an elongated rod to a position disposed between said two fixed dies, said feed mechanism having two cutting edge means such that upon reciprocation of said feed mechanism in one direction, one cutting edge means shears off a workpiece from said elongated rod and feeds said sheared off workpiece to one fixed die and, upon reciprocation of said feed mechanism in the opposite direction, the other cutting edge means shears off another workpiece from said elongated rod and feeds said sheared off workpiece to the other fixed die, whereby said feed mechanism is operable to cut off said workpieces and feed the cut-off workpieces alternately to each of said two fixed dies as the movable dies move in opposite directions.

2. A reciprocating press according to claim 1 including mounting means on said feed mechanism for carrying said workpieces to said fixed dies after the workpieces have been sheared off from said elongated rod by said cutting edge means.

3. A reciprocating press according to claim 2 including a cam mounted on said crankshaft, and operable means between said cam and said feed mechanism for reciprocating the latter in synchronism with the reciprocating motion of said movable dies.

4. A reciprocating press according to claim 3 wherein said cam is mounted on said crankshaft between said two crank arms.

5. A reciprocating press according to claim 3 wherein said operable means includes a double arm lever, and means mounting said double arm lever for reciprocal movement about an axis perpendicular to the rotational axis of said crankshaft.

* * * * *